United States Patent [19]

Samodovitz

[11] Patent Number: 4,617,496

[45] Date of Patent: Oct. 14, 1986

[54] WARM-UP CIRCUIT WITH TIMED SHUT-OFF OF THE WARM-UP CURRENT

[76] Inventor: Arthur J. Samodovitz, One Lakeshore Dr. #A-4, Farmington, Conn. 06032

[21] Appl. No.: 758,589

[22] Filed: Jul. 25, 1985

Related U.S. Application Data

[63] Continuation of Ser. No. 615,289, May 30, 1984, abandoned, which is a continuation-in-part of Ser. No. 583,350, Aug. 18, 1983, abandoned, and a continuation-in-part of Ser. No. 268,724, Jun. 1, 1981, abandoned.

[51] Int. Cl.[4] ..... H05B 39/02

[52] U.S. Cl. ..... 315/208; 315/50; 315/71; 315/362; 315/291; 315/311; 307/135

[58] Field of Search ..... 315/200 R, 208, 291, 315/311, 360, 362, 50, 71, 106, 107; 323/321, 908; 307/135

[56] References Cited

U.S. PATENT DOCUMENTS

| | | | |
|---|---|---|---|
| 3,028,525 | 4/1962 | Morton | 315/71 X |
| 3,215,891 | 11/1965 | Fritz et al. | 315/50 |
| 3,309,544 | 3/1967 | Lawson | 315/200 R X |
| 3,388,293 | 6/1968 | Petschauer | 315/129 X |
| 3,612,945 | 10/1971 | Stevens | 315/200 R |
| 3,742,295 | 6/1973 | Irie | 315/200 R X |
| 3,943,375 | 3/1976 | Williamson | 315/360 X |

*Primary Examiner*—David K. Moore
*Assistant Examiner*—Vincent DeLuca

[57] ABSTRACT

A switch circuit is disclosed which warms-up a load prior to complete turn on. The circuit includes a single pole double throw switch and an amplifier. The input to the amplifier connects to the off throw of the switch and the amplifier is rendered nonconducting when the switch is off. However, when the switch is between its off and on position, as it is being thrown on, the amplifier conducts a half wave rectified warm-up current to the load. Then, when the switch is on, the amplifier is bypassed by a short circuit connecting between the on throw terminal of the switch and the load, and the load is driven to 100% capacity via this short circuit.

33 Claims, 4 Drawing Figures

WARM-UP CIRCUIT WITH TIMED SHUT-OFF OF THE WARM-UP CURRENT

This is a continuation of Ser. No. 615,289, filed May 30, 1984, now abandoned, which is a continuation-in-part of the Warm-up Circuit, Ser. No. 583,350, filed 8/18/83 now abandoned, and a continuation-in-part of the Warm-up Circuit, Ser. No. 268,724, filed 6/1/81; Ser. No. 268,724 is now abandoned.

FIELD OF THE INVENTION

The invention relates generally to switches, and more particularly to an electronic circuit working in conjunction with a switch to warm-up a load at a moderate rate prior to complete turn-on.

DESCRIPTION OF THE PRIOR ART AND BACKGROUND

The life of a light bulb is limited by two factors-the high temperature of the filament during normal operation and the surge current which flows through the filament when the bulb is switched on by a standard switch, typically single pole single throw. In fact, it is commonly observed that light bulbs burn out at the instant they are switched on; this indicates the harm done by the initial surge current. This current heats the filament rapidly, and weakens it by "thermal shock". Also, in sensitive electronic systems, the surge current can disrupt other electrical components powered by the same power supply or sharing the same ground plain.

If the filament of the light bulb system survives this rapid heating, its impedance will increase, and it will operate at the steady state, rated current.

The surge current can be decreased if the filament is always kept warm with a conventional "keep-alive" resistor providing a continual and substantial current to the bulb. See Petschauer Pat. No. 3,388,293.

A second conventional way to decrease the initial surge current is to insert a current limiter between the power source and the bulb. Note that this current limiting circuitry passes not only the initial current but also the steady state, rated current.

A third known circuit to limit the surge current is shown in Stevens, Pat. No. 3,612,945 and Irie, Pat. No. 3,742,295. These circuits provide gradual turn-on current to the bulb once the switch is situated in the on position. They utilize a resistor to gradually charge a capacitor when the switch is turned-on. Until the capacitor charges to a threshold level, a limited current is delivered to the bulb through another resistor, and once the threshold capacitor voltage is reached, a triac is activated and delivers the operating current to the bulb. Note that there is always some electrical component between the power source and the bulb during the bulb's operation.

Another conventional device to limit initial surge current is a rheostat which utilizes a variable, transformer to control the voltage across the filament manually. The voltage is gradually increased by manually turning the rheostat dial after the filament is warmed by the lesser voltage. Also, there are "dimmer" switches which utilize a rheostat or a variable, series inductance and are manipulated with a switch like lever instead of an obvious dial.

Also, Lawson Pat. No. 3,309,544 discloses a three position switch having off, half power, and full power switch positions.

The parent application to this one, Ser. No. 583,350, provides a warm-up current to a load when the switch is between the off and on positions, and afterwards provides a direct short to the load when the switch is on. But, in the event that the switch is purposely held in transition, the parent invention will continue to deliver the warm-up current and dissipate power internally.

SUMMARY OF THE INVENTION

An object of the present invention is to reduce the surge current which normally flows through a light bulb when the light bulb is initially turned on, and to increase the life of the bulb.

A second object is to reduce surge currents present when other loads such as motors are switched on to protect them and interconnected circuitry.

A third object of the invention is to provide a direct, short circuit between the power supply and the load when the controlling switch is in the on position.

A fourth object of the invention is to minimize power dissipation when the switch is in the off and on positions; and in transition.

A fifth object of the invention is to have the warm-up current automatically shut off if the switch is held in transition too long so as to keep the power dissipation low.

A sixth object of the invention is to be able to drive a variety of loads with a broad range of current demands such as light bulbs, motors, appliances, and electrical equipment.

A seventh object is to be simple and convenient to operate.

An eigth object is to be economical.

A ninth object is to be small enough and low power enough to install in standard sized wall switches and on lamps and other electrical devices.

To satisfy these objects and others, one embodiment of the present invention presents a high impedance, low power consumption mode when the switch is in the off position, provides a half wave rectified warm-up current to the load when the switch is between the off and on positions, and provides a direct short between the power supply and the load when the switch is in the on position. Also, the invention minimizes power dissipation inside the switch circuitry while the switch is in transition in the following ways. First, a silicon controlled rectifier can be utilized to deliver the warm-up current, and it causes a minimal voltage drop and power dissipation. Second, there is other circuitry which terminates the warm-up current after a time period in the event that the switch is purposely held in transition for an extended time.

DETAILED DESCRIPTION OF THE FIRST EMBODIMENT

Figure 1:
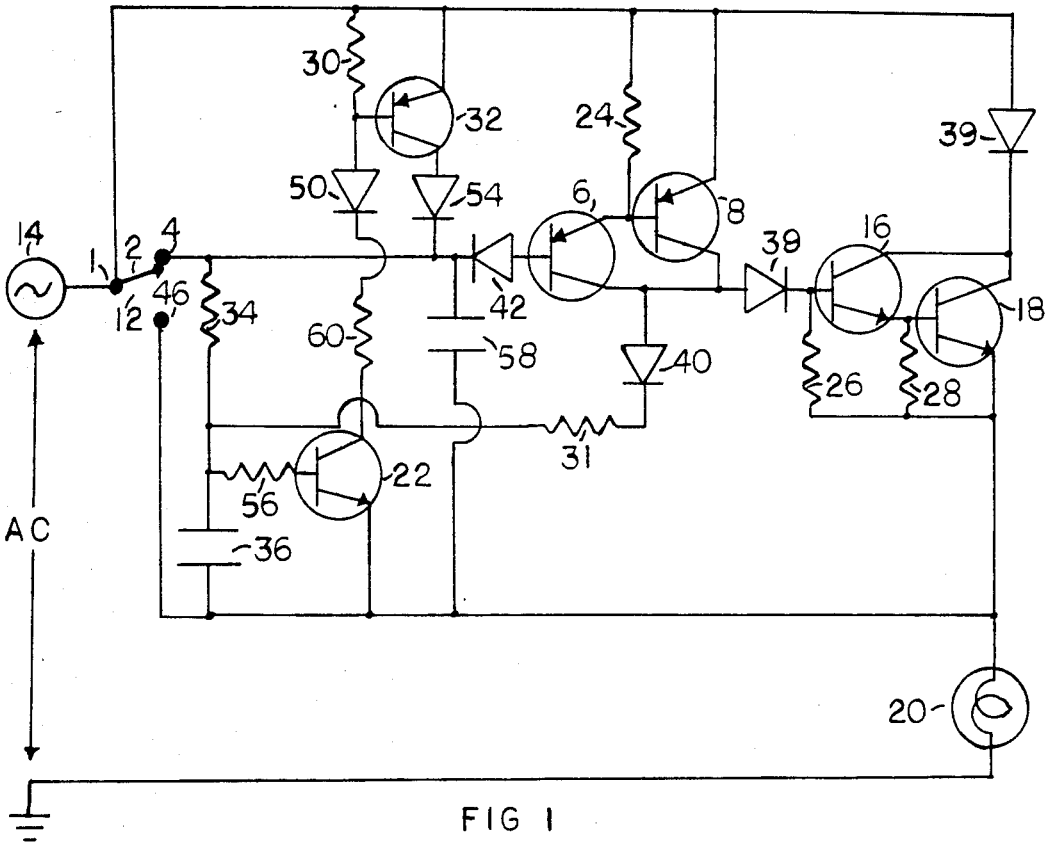
FIGS. 1-4 are circuit diagrams of the first, second, third, and fourth embodiments of the invention, respectively. Components in the different figures bearing the same reference numerals are identical.

The first embodiment is shown in FIG. 1, and functions in the following manner. When a movable switching mechanism or switch arm 2 connects to off throw terminal 4, pnp transistors 6 and 8 are shut off because there is zero voltage across their emitter to base junctions. This is because the same voltage is applied to the base of pnp transistor 6 (the input to darlington pair 6 and 8) and the emitters of transistors 6 and 8 which are connected to pole 1 of single pole double throw switch 12 and AC power supply 14. In the most common application of the invention power supply 14 is 120 volts RMS and the switch is a wall switch. With transistors 6 and 8 off, no current flows into the base of transistor 16, (the input of darlington pair 16 and 18). As a result, transistors 16 and 18 do not conduct, and no significant current flows through them to the load, light bulb 20 in the most common application.

However, during this off condition of the switch there are some minute currents which flow to the load and cause a minute power dissipation. There is a leakage current through each emitter/collector route of transistors 6,8,16,18, and 22 (npn). When these transistors are selected for use in the circuit, they should be specified to have a small leakage current for the operating voltage, preferrably less than 10 microamperes. Then, shunting resistors 24,26,28, and 30 are specified to prevent the leakage currents from inadvertantly activating transistors 8,16,18, and 32 respectively whose inputs are fed by these collector/emitter currents. In embodiment one, resistor 24 is suggested at 33 kilohms (or less) so that the 10 microamperes leakage current of transistor 6 will shunt through resistor 24 and not cause enough voltage drop to activate transistor 8. Similarly, resistors 26 and 28 are suggested at 10 kilohms to prevent inadvertant turn on of transistors 16 and 18, respectively. Note that through these shunting resistors flows the leakage of two or three transistors. Also, the magnitude of shunting resistor 26 is kept small to shunt the leakage current away from resistor 31, and capacitor 36 to prevent inadvertant charging of this capacitor. Resistor 30 is suggested at 33 kilohms to shunt leakage of transistor 22. The suggested values for components given above and below are one set of working components, and not intended as limitations on the scope of the invention because other values will work. For example, smaller shunting resistors can be used with the same effect of preventing inadvertant turn on of the respective transistors, or larger resistors if the leakage currents were less. However, these resistors should not be so small as to pass all the operating current from the previous amplification stage when the transistors are meant to turn on.

There is another minute current flowing during the off condition of switch 12. It flows from power supply 14, through off throw contact 4, resistor 34, and capacitor 36, and to the bulb. But, this current is small because resistor 34 is very large, suggested at 500 kilohms to 1 megohm. Note that there will be no leakage across the emitter to collector path of transistor 32 since its emitter and collector are held at the same potential.

Also, during the off condition and negative voltage period of power supply 14, diodes 38 and 39 prevent reverse bias of the base to emitter junctions of transistors 16 and 18 which would otherwise breakdown and cause wastefull current flow. Similarly, diode 40 prevents current flow through capacitor 36, resistor 31, the collector to base junction of transistor 6, and diode 42 during negative voltage.

When the switch 12 is thrown, it will spend some time traveling between off throw contact 4 and on throw terminal 46. This period I call the transition of the switch and refers to any time switch arm 2 is not resting on either the off or on throw terminals. The amount of transition time in a conventional, single pole double throw wall switch depends on how fast or hard the individual pulls the switch lever. For the invention to work well, there must be enough transition time for the warm-up current to warm-up the filament. Several cycles time is useful in warming up the filament, keeping in mind that 10 cycles of a 60 hz supply requires only 0.1 seconds. From simple observations, it appears that a typical transition time is a few tenths of a second. If a longer warm-up time is needed for a particular load application, the switch can be mechanically designed so that the transition travel distance of mechanical arm 2 is extended (or less preferrably, extra drag is associated with the movement of the switch to slow it).

During transition, switch arm 2 no longer connects to off throw 4, and when power supply 14 puts out positive voltage, a current will flow from the power supply through the emitter to base junctions of transistors 6 and 8, diode 42, resistor 34, and capacitor 36. This current activates said transistors, and causes them to output current from their collectors to feed the base to emitter junctions of transistors 16 and 18. Since all transistors 6, 8, 16, and 18 are in cascade, a small current out of the base of transistor 6 causes a much larger current output from the collector to emitter path of transistor 18. For example, with the gain of transistors 6, 8, and 16 at least 75 each, and the gain of transistor 18 at least 10, the overall gain exceeds 4,000,000. High gain is important because the input current to transistor 6 is limited by resistor 34, and resistor 34 is made very large to minimize power dissipation during the off state of the switch. Note that the gain of transistor 18 is specified at only 10 because transistor 18 must handle a moderate current, and such transistors typically have low gain.

Because transistors 6 and 8 are only activated by positive voltage put out by the power supply and because of rectifiers 38 and 39, transition current will only flow to the load approximately half the time. As a result, the average power delivered to the bulb during transition is much less than that delivered to the bulb through a conventional light switch when it is initially switched on. Therefore, the bulb driven by the first embodiment warms-up more gradually than in the conventional system, and experiences much less thermal shock and current surge.

The first embodiment also includes means for terminating the warm-up current after 1–2 seconds so that the total energy dissipated in the first embodiment circuitry is minimized; it is a safeguard to protect this circuitry under abnormal switching modalities by the user—when he or she purposely and wantonly holds the switch in transition for a long period of time. First, note that 3–4 volts will appear across the forward biased diode 39 and the collector to emitter junction of transistor 18 together, during transition current flow, and these two components pass the bulk of the transition current. This voltage results from the four levels to the output amplifier, transistors 6, 8, 16, and 18 and the voltage drop across resistor 34 when supplying the input current to said amplifier. Under normal operation of the switch, the transition time is less than 0.5 seconds and there is little time for any significant heating of diode 39 and transistor 18. But, if the user is "playing" with the switch and holds it in transition, or if the switch mechanism breaks leaving an open circuit between the pole and either throw terminal, then without the shut off circuitry discussed below, significant power would continually dissipate in diode 39 and transistor 8, 1.5 watts for a 100 watt light bulb load. Although a 1.5 watt dissipation is undesirable, it can easily be accomodated by conventional semiconductors and packaging. However, if the load is 500 watts, then 7.5 watts will result, and this high level of heating should be avoided, even if the circuitry can take it.

Here is how the safeguard, termination circuitry works. Whenever the transition current flows, so does a current through resistor 34, and through diode 40 and resistor 31 via the emitter to collector paths of transistors 6 and 8, and into capacitor 36. These currents gradually charge capacitor 36, and if the transition current flows too long, capacitor 36 charges to 0.7 volts and activates transistor 22. Then, transistor 22 activates transistor 32 by sinking its base current, and transistor 32 drives resistor 34 through diode 54 to approximately 1½ "p-n diode drops" below the line voltage. This chokes off transistors 6 and 8 because they, together with diode 42, will no longer be adequately forward biased; this latter trio requires three "p-n diode drops" below the line voltage before they will conduct. (It may be necessary to increase the degree of choke off by adding another diode in series with diode 42 or by shorting out diode 54.

Diode 40 prevents discharge of capacitor 36 during negative voltage out of the supply, and is assisted if the collector to emitter breakdown voltage of transistors 6 and 8 exceeds the negative voltage of the supply. Resistor 31 should be less than resistor 34, about 180 kilohms if resistor 34 is 1 megohm, for the following reason. If the user is "playing" with the switch and switching it between the off state and transition, then capacitor 36 charges through the 1 megohm and 180 kilohm resistors during transition, and discharges through the 1 megohm resistor during the off state. As a result, the charging rate is greater than the discharge rate and the threshold voltage of capacitor 36, approximately 0.7 volts, will be reached unless the off time of the switch exceeds the transition time. Therefore, the maximum average power which can possibly be dissipated by transistor 18 and diode 39 is reduced. In the above example, the charging rate was measured at approximately four times the discharge rate due to the fact that the charging current was four times larger, so the maximum average power dissipation is reduced by a factor of five.

Here is how the charging and discharging rates are calculated: While in transition, the voltage at the collector of transistor 6 is approximately 2.5 volts above the light bulb voltage due to the p-n voltage drops across diode 38 and transistors 16 and 18; 1.1 volts has been allowed for the base to emitter junction of transistor 18 since it passes 100–500 milliamperes. Therefore, the initial charging current to capacitor 36 is 2.5V minus 0.7V of diode 40 and divided by 180 kilohms. Since transistor 6 is in saturation during this time, the voltage at the base of transistor 6 is approximately 2.2 volts above the light bulb, and the charging current through resistor 34 is calculated from that. Then, when the power supply puts out negative voltage and the switch is in transition, the capacitor discharges slightly due to leakage currents through the resistor 34, reversed biased diode 54, and bipolar pnp transistor 32; through resistor 34, reversed biased diode 42, and reversed biased transistor 6, and resistor 24; and through resistor 31, reversed biased diode 40, and reversed biased transistors 6 and 8. These components should be specifed so that these leakage currents are much smaller than the charging currents keeping in mind that the charging current is "powered" by only a few volts whereas the leakage current is powered by the full, negative line voltage (extra output voltage drop may be needed to account for higher leakage, taking the form of extra diodes in series with diode 38). The size of resistor 31 can be reduced if the leakage currents cannot economically be kept low enough. When the switch is turned off, then capacitor 36 discharges through resistor 34.

By way of example, the maximum, transition conduction time (controlled by the charging rate of capacitor 36) is designed in the range 1–2 seconds for the range of specified loads. This allows plenty of time for the switch to travel from the off to the on state during normal operation and for tolerances in the components. The precise size of resistor 31 and capacitor 36 (suggested at 4–5 microfarads) is calculated from a knowledge of the forward biased voltage drops across diode 38 and transistors 16 and 18, and the voltage drop across resistor 34 necessary to sink the input current to the output amplifier. As the load increases, so does the voltage drop across the base to emitter junction of transistor 18 and resistors 34 and 31 so the charging rate of capacitor 36 increases and the maximum warm-up current conduction time decreases. This is advantageous because for heavier loads, there is more dissipation in diode 39 and transistor 18 while delivering the warm up current, and a shorter maximum conduction time better limits the maximum total energy dissipation for one pull of the switch, and the average power dissipation for the abnormal mode of switching between transition and off or on condition. For example, with a 1.5 second conduction time, a 5 ampere load, an output voltage drop of 4 volts, and a ½ duty cycle, there will be a total energy dissipation of 15 joules for one, abnormally long duration, pull of the switch.

Resistor 56 serves the following function. If the switch is held in transition long enough for capacitor 36 to charge to approximately 0.7 volts activating transistor 22, then the output amplifier shuts off and the bulb voltage drops to approximately zero. Then, transistor 32 delivers its choke-off current through resistor 34 and the parallel branches of capacitor 36 and resistor 56. If resistor 56 is made large, approximately ½ that of resistor 34, then a voltage divider will result and capacitor 36 will charge to many volts. This helps to thwart an unwarranted attempt by the user, while playing with the switch, to keep the transition current on since this many volt charging of capacitor 36 will take much time to discharge below the threshold voltage of 0.7 volts.

Capacitor 58 prevents the amplifier from flickering between off and on when the termination circuitry just begins to activate. The value of capacitor 58 is not critical, but I suggest 680 picafarads as it is in parallel with resistor 34. Resistor 60 limits the current out of the base of transistor 32 and I suggest 47 kilohms. Diode 50 prevents discharge of capacitor 36 through transistor 22's collector leg.

When the switch is turned on, power supply 14 shorts directly to the load through on throw contact 46, and the load is driven to the full line voltage. Also, there is no current drawn into the circuitry components since they are bypassed by this short circuit. When the switch is on, capacitor 36 will discharge through leakage currents, or through a few megohm resistor which can be placed across the base to emitter junction of transistor 22 to ensure this discharge.

In a slight variation to the first embodiment, diodes 38 and 39 can be short circuited, and another diode connected between the output amplifier and the load, namely with its anode connected to the resistor 28/emitter of transistor 18 junction and its cathode connected to the bulb 20/emitter of transistor 22 junction instead of the previous short circuit.

In another variation to the first embodiment, a silicon controlled rectifier substitutes for transistors 16 and 18, diode 39, and resistor 28—the cathode gate of the SCR connects to the diode 38/resistor 26 junction, its anode connects to the power supply line, and its cathode connects to the load and the other end of resistor 26. Also, a diode is helpful, with is anode connecting to the SCR's cathode, and the diode's cathode connecting to the SCR's gate to prevent excessive reverse bias of the SCR's cathode to gate. See Millman and Taub, *Pulse, Digital, and Switching Waveforms,* McGraw Hill publisher, pages 465–474.

The electronic components of the first embodiment can be made least expensively as an integrated circuit. However, it may be necessary to fabricate transistor 18 and diode 39 in a separate package to handle their power dissipation, and to fabricate capacitor 36 separately due to its large size.

Note that the first embodiment will ordinarily be sold as a switch, single pole double throw, with the prescribed circuitry attached, and without the power supply or the load, and as such will have one input for the power supply line (pole 1) and one output lug shorted to on throw contact 46 to feed the load. So, the invention will be compatible with conventional single pole single throw wall switches which also have one input lug and one output lug. In fact, the off throw terminal of the invention can be concealed from the user to prevent confusion during installation.

The most common material for transistors and diodes is silicon and this will work well, but germanium diodes and transistors can also be used to provide lower voltage drops across the various p-n junctions and so, lower the power dissipation in transistor 18 and diode 39 while delivering the warm-up current. If germanium is used, then the resistor values should be halved.

Besides ordinary single pole double throw switches, one or more slow moving re1ays can also be used if they form a single pole double throw switch.

Also, the termination circuits of the first and second embodiments of the invention can be used when the power supply is DC; the reverse bias protection diodes are not needed, a resistor or zener is needed at the output of the output amplifiers to limit the warm-up current, and resistor 34 should be clipped out.

DETAILED DESCRIPTION OF THE SECOND EMBODIMENT OF THE INVENTION

Figure 2:
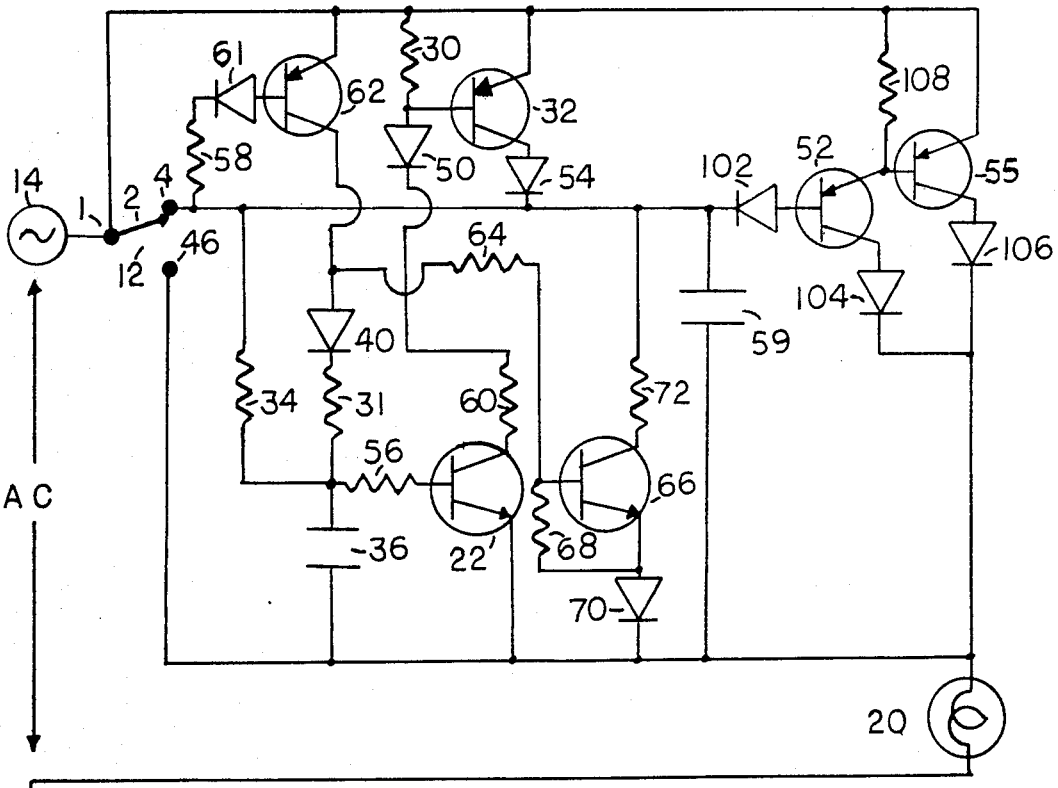

The second embodiment is shown in FIG. 2, and is similar to the first in the way output amplifier, pnp transistors 52 and 55, is rendered nonconducting when the switch is in the off position. The second embodiment also comprises two other sub-circuits, one consists of elements 58–72 and provides the input current to the output amplifier when it delivers the warm-up current, and dissipates very little power internally when the switch is in the off position.

This is how it works: When the switch is in the off position, pnp transistor 62 is turned off since its base and emitter have the same potential. As a result, no current flows into the base of npn transistor 66 (leakage current shunts through resistor 68), transistor 66 is shut off, and no current can flow out of the base of output amplifier transistor 52. In summary, this first sub-circuit is shut off when the switch is off and no current flows except for small leakage. When used without the second sub-circuit, elements 34, 36, 56, 22, 60, 54, 30, 32, 50, 31, and 40, the first sub-circuit works independently and also provides the transition input current to the output amplifier. When switch arm 2 leaves off throw contact 4, a small current flows from the emitter to base junction of transistor 62, diode 61, resistor 58, and capacitor 59 and resistor 34, and renders transistor 62 conducting. Then, transistor 62 delivers a sizable current to activate transistor 66, transistor 66 drives the output amplifier through resistor 72, and the output amplifier delivers the transition, warm-up current to the load. Once transistor 66 begins to conduct during each positive going cycle of the power supply voltage, the base current out of transistor 62 then flows predominantly through resistor 72 and the collector to emitter path of transistor 66 because capacitor 59 charges quickly and resistor 34 is very large. Because this embodiment utilizes only two stages of amplification in its output amplifier, base drive resistor 72 should be small, for example 20 ohms, or can even be eliminated with a short circuit, since the output amplifier needs several milliamperes of drive; there is no need to drop additional voltage in the input branch to the output amplifier as this may cause additional voltage drop across the output amplifier's emitter to collector pathways. Note that without sub-circuit 2, only one stage of output amplification is needed such as medium power transistor 55; transistor 52, diode 104, resistor 72, and diode 61 can be removed, and the output amplifier voltage drop and power dissipation will be smaller, approximately four "p-n junction" voltage drops to the load.

With resistor 72 at 20 ohms, resistors 64 and 58 can be 470 ohms and 15 kilohms, respectively, so that transistor 62 can adequately drive transistor 66 and transistor 66 can drive the output amplifier. Capacitor 59 need not be large, 200 picafarads will work to momentarily receive and store some base current out of transistor 62 until transistor 62 activates transistor 66, and to later prevent on/off flicker as does capacitor 58 in the first embodiment. Diode 70 prevents reverse bias of transistor 66, diode 61 prevents reverse bias and breakdown of transistor 62 when the switch is in transition so that capacitor 36 does not discharge then through resistor 58, diode 102 prevents reverse bias of transistors 52 and 55 during transition so that capacitor 36 does not discharge and also ensures that the base to emitter junction of transistor 62 is forward biased at the onset of transition by setting the minimal voltage drop across the transistor 62, diode 61, and resistor 58 leg less than that across the transistor 55, transistor 52, and diode 102 leg.

Diodes 104 and 106 prevent reverse bias of transistors 52 and 55 and rectify the warm-up current. These two diodes are preferred over an alternate configuration where a substitute diode connects between transistors 52 and 55 collectors' junction and the on throw terminal 46 because they cause less voltage drop between the line voltage and load. Resistor 108 shunts the leakage current of transistor 52 away from the emitter to base junction of transistor 55, and can be 10 kilohms.

The choke-off or termination circuitry (second sub-circuit) of the second embodiment works very similarly to that of the first except the main source of charging current to capacitor 36 is from transistor 62 via diode 40 and resistor 31.

In a variation to the second embodiment, an SCR can substitute for the output amplifier (including diodes 104 and 106), with its anode connecting to the line, its anode gate connecting to the anode of diode 102, and its cathode connecting to on throw 46. Without the choke-off circuitry, diodes 102 and 61 can be shorted to lessen the output voltage drop when the SCR begins to conduct.

DETAILED DESCRIPTION OF THE THIRD AND PREFERRED EMBODIMENT

Figure 3:
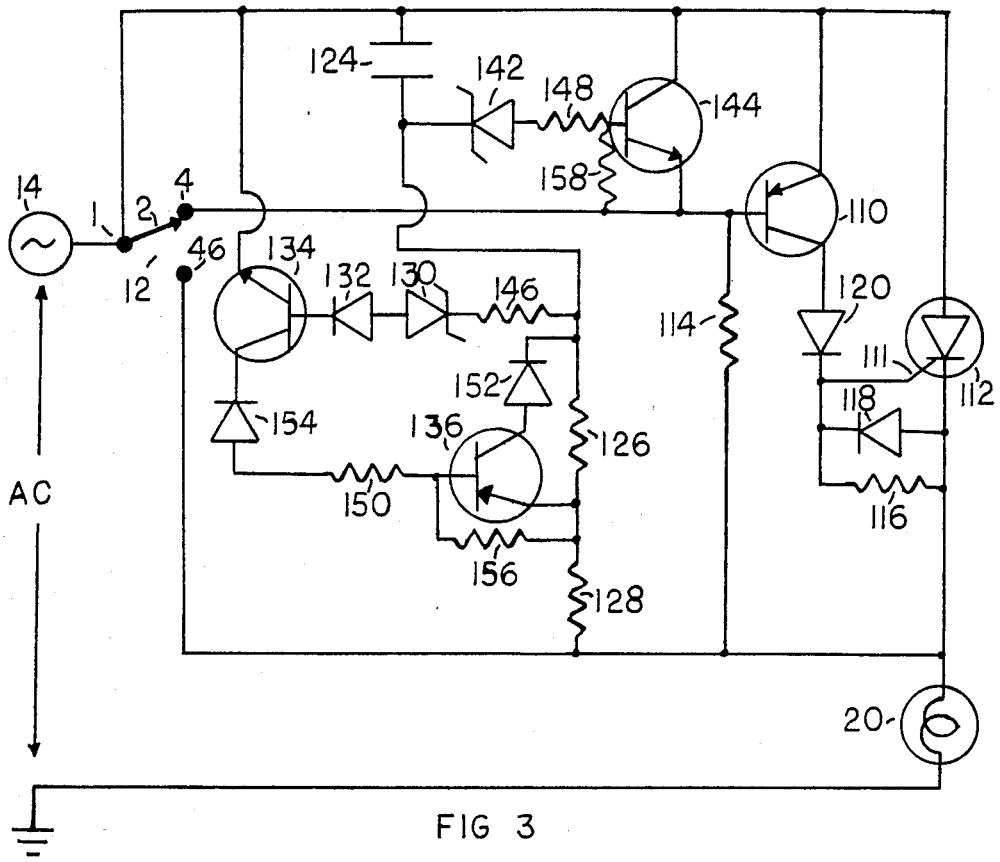

The third and preferred embodiment is shown in FIG. 3, and is designed to minimize internal power dissipation while providing the warm-up current. The circuitry providing the warm-up current can be used apart from the choke-off or termination network, and operates as follows: When switch 12 is off (as shown), transistor 110 is off because its base and emitter are both shorter together and prevents current from flowing to the cathode gate 111 of silicon controlled rectifier 112 through the transistor 110's emitter to collector junction (I use the term SCR to include also the low power model of SCR which is sometimes referred to as silicon controlled switch, and a triac when it passes half wave rectified current). As a result, SCR 112 does not conduct any warm-up current to the load. There are two small currents to the load 20 at this time, that through large resistor 114 (500 kilohms to 1 megohm) and leakage current through the emitter to collector path of transistor 110 which avoids the gate of SCR 112 via shunting resistor 116 (22 kilohms or less for 10 microamperes leakage). Diode 118 prevents reverse bias of the gate to cathode junction of SCR 112, and diode 120 prevents reverse bias of transistor 110 and wasteful resulting currents. SCR 112 should be chosen such that it can tolerate the line voltage without breaking down in either direction.

When switch 12 is in transition and power supply 14 puts out positive voltage, transistor 110 conducts since it is forward biased, and activation current flows out the base of the transistor 110 through its base or activation control port and through resistor 114, and transistor 110 delivers drive current from the power supply 14, through the collector or power input port and out the emitter to feed the cathode gate of SCR 112 via diode 120. Then, SCR 112 conducts half wave rectified, warm-up current to light bulb 20. SCR 112 should be specified so that it can deliver several amperes and have low leakage current when reversed biased; Radio Shack's SCR #276-1067 worked fine in a 110 Volt RMS test circuit. If the SCR has a gain of 10,000 which is common, and transistor 110 has a gain of 100, SCR 112 can pass a half wave rectified current of 5 amperes RMS and dissipate approximately 5 watts. In a test using a 3.5 ampere load at 110 Volts (four 100 watt light bulbs), the SCR dropped 1.7 volts and felt just warm during continuous operation. In normal operation of the switch, this warm-up current will flow for less than 0.5 seconds so the SCR will dissipate little total energy.

For some loads, it may be desirable to provide less than a half wave rectified current for the warm-up period. To accomplish this, insert a capacitor between pole 1 of the switch and off throw 4. As a result, when the switch is in transition and the voltage goes positive, the turn on of transistor 110 will be delayed as it takes time to charge up said capacitor to 0.7 volts to forward bias the emitter to base junction of transistor 110. Note that this capacitor charges through large resistor 114, and its charging rate is so regulated. For example, a 10,000 picafarad capacitor and 1 megohm for resistor 114 will delay turn on of transistor 110 until the power supply voltage is approximately ⅓ into its positive cycle; a larger capacitor will increase the delay period.

When the switch turns on, power supply 14 shorts directly to the load 20 via on throw contact 46, and the warm-up circuitry is bypassed. As a result, there is no power wasted when the switch is on, and the load is driven to 100% capacity.

As discussed above, some user's may operate the switch abnormally and hold the switch in transition for long periodes of time. Therefore, an appropriate wattage SCR should be used to handle this power dissipation (approximately 5 watts for a maximum 5 ampere load) or the choke-off, termination circuit shown and a lower wattage SCR. (The choke-off circuitry discussed in the description of the first and second embodiments can also be used with the anode of diode 40 connecting to the collector of transistor 110, resistor 34 connecting to off throw 4, and the cathode of diode 50 connecting to off throw 4. In addition, a zener diode is inserted between the cathode of diode 120 and the SCR gate/diode 118 cathode/ resistor 16 junction, with the anode of said zener facing diode 118. This zener ensures adequate voltage across resistor 31 to provide the charging current to capacitor 36. A 5.1 volt zener can be used, and resistor 31 can be decreased to 35 kilohms. Despite this zener, the average output voltage drop will remain low since this SCR only needs gate current for a short time at the onset of each positive half wave of power supply voltage; afterwards the relatively low gate voltage does not lower the SCR cathode voltage. Finally, resistor 116 should be connected from the cathode of the zener to the cathode of the SCR instead of the previous connection to prevent leakage current out of the collector of transistor 110 from inadvertently charging capacitor 36.)

Preferably, the third embodiment utilizes the termination circuitry shown in FIG. 3, components 124–15B, which is effective in shutting off the warm-up current after a desired interval. This is how it works: When the switch is off, the voltage across the capacitor 124, resistor 126, and resistor 128 leg alternates symetrically by a 120 volt line voltage, and resistors 126 and 128 limit the charging current to capacitor 124 for both polarities of the line voltage, so capacitor 124 sits at zero volts. Then, when the switch goes into transition, the voltage at the input of load 20 follows approximately the positive portion of the power supply voltage and is zero during the negative portion. As a result, the current through capacitor 124 flows predominantly from bottom to top (during the negative portion of the voltage), and capacitor 124 gradually charges with its bottom plate positive with respect to its top plate. After a time defined by this charging rate and the zener diode 130 voltage drop and the p-n junction drops across diode 132 and transistor 134, the voltage across capacitor 124 charges to a sufficient level to activate transistor 134. Then, transistor 134 conducts the base current out of pnp transistor 136 and transistor 136 shorts out or bypasses resistor 126 during the charging period of capacitor 124. As a result, capacitor 124 charges more rapidly since its charging current is limited by only resistor 128, and not resistor 128 plus resistor 126. Soon afterwards, capacitor 124 reaches a voltage sufficient to overcome the breakdown voltage of zener diode 142 and activates transistor 144; zener diode 142 should have a breakdown voltage several volts greater than that of zener diode 130. When transistor 144 is rendered conducting, it delivers the power supply voltage to the base of pnp transistor 110 and so chokes off transistor 110 and SCR 112 and terminates the warm-up current. Using the following suggested values for the components of this termination and other circuitry, the turn off time of the warm up current can be limited to approximately 1.5 seconds: capacitor 124—1.5 microfarads, resistor 114—1 megohm, resistor 126—2 megohms, resistor 128—270 kilohms, resistor 150—270 kilohms, resistor 146—330 kilohms, resistor 148—220 kilohms, zener diode 130—15 volts, zener diode 142—25 volts, resistor 156—15 kilohms, and resistor 158—100 kilohms. Also, the leakage currents through transistors 134 and 136 should be smaller than the charging currents. These values are suggested and are not intended to limit the scope of the invention as other values will work. For example, a larger capacitor 124 will lengthen the maximum warm-up current delivery time, and alternately, smaller values for resistors 126 and 128 and zener diodes 130 and 142 will decrease the maximum warm-up time.

Diodes 154, 132, and 152 prevent reverse bias of transistors 134 and 136. Resistors 156 and 158 shunt leakage current away from the input of transistors 138 and 144, respectively. Resistor 146 limits the current into transistor 134 when capacitor 124 is sufficiently charged, and its size is large to limit the amount of current which diverts from its path to the capacitor 124 during the time that the capacitor is charging. If resistor were much smaller, too little current would flow into capacitor 124 during its transitional charge phase, and there would not be enough to activate transistor 144 and supply the other discharge currents through resistors 146, 126, and 128 during the next positive portion of the power supply voltage. Similarly resistor 148 is made large to limit the current drawn from capacitor 124 during the choke-off operation.

After the warm-up current is choked off, the symetrical voltage across the capacitor 124, resistor 126, and resistor 128 leg resumes since the voltage at the input to load 20 returns to zero volts. But, capacitor 124 remains charged in its existing polarity, because the current upward into capacitor 124 is limited by only resistor 128, 270 kilohms (transistor 136 is still activated to bypass resistor 126 in this direction) whereas the downward discharge current is limited by the combination of resistors 128 plus 126, a total of 2.27 megohms. This retention of capacitor 124 voltage is important to keep transistor 110 turned off after the initial 1.5 second warm-up to prevent extra warm-up current flow and power dissipation in SCR 112. When the switch finally reaches the on position, no voltage appears across the capacitor 124, resistor 126, and resistor 128 leg, and capacitor 124 gradually discharges to zero. Then, it is ready to allow the warm-up current to flow during subsequent transitional periods—when the switch is turned off and on later. During normal operation of the switch, less than 0.5 seconds of transition time, capacitor 124 never reaches a threshold voltage, approximately 17 volts for the suggested values, so transistor 134 and 136 are not activated and capacitor 124 discharges to zero volts when the switch is either off or on.

If the third embodiment is sold without the switch, a diode can be added at the emitter of transistor 144 and another dioded connected at the base of transistor 110 to protect these transistors in the event that the invention is inadvertantly installed without the connection to the pole of the switch.

In a variation to the third embodiment, resistors 148 and 158, and transistor 144 are removed and the anode of zener diode 142 shorts directly to off throw contact. In this configuration, if the choke-off circuitry is activated, and the switch returned to the off position, the voltage of capacitor 124 will fall to between the breakdown voltages of zener diodes 130 and 142 (because the charging current shunts through zener diode 142 and to the low output impedance of the power supply when the capacitor reaches the breakdown voltage of zener 142, and then capacitor 124 partially discharges when the power supply voltage goes positive). Then if the switch is returned to the transition position, the warm-up current will be delivered for a short time while capacitor 124 charges from that intermediate level to the level of the zener diode 142 breakdown voltage. This current will begin to warm-up the load prior to complete turn on. However, in this variation, resistor 128 should be decreased (suggested level of 120 kilohms) to provide the additional charging current to capacitor 124 which is needed to directly drive resistor 114 to choke-off the warm-up current. Also, in this variation, the breakdown voltage of zener diode 142 can be lessened to a suggested level of 20 volts to make it easier for capacitor 124 to reach this threshold, choke-off voltage.

One feature of the choke-off circuitry of the preferred embodiment not in that of the first and second embodiments is that the maximum turn off time to the warm-up current can be designed with greater definitiveness. In the first and second embodiments, the charging current to threshold capacitor 36 depended on the voltage drop across the base to emitter junction of output transistor 18 in the first embodiment and on the emitter to collector voltage across output transistor 54 and diode 106 in the second embodiment, and these voltages vary slightly with the load. (The first and second embodiments tend to lessen the maximum warm-up time for heavier loads which may be desirable for some applications). But, the charging time of capacitor 124 of the third embodiment depends on the sizes of the charging and discharging resistors and capacitor and does not vary with load. Also, the charging of capacitor 36 is more heavily effected by leakage current than that of capacitor 124 since the charging current to capacitor 36 is "powered" by only a few volts and the discharge leakage is powered by 120 volts whereas the charging current to the third embodiment capacitor 124 is powered by the full 120 volts.

DETAILED DESCRIPTION OF THE FOURTH EMBODIMENT

Figure 4:
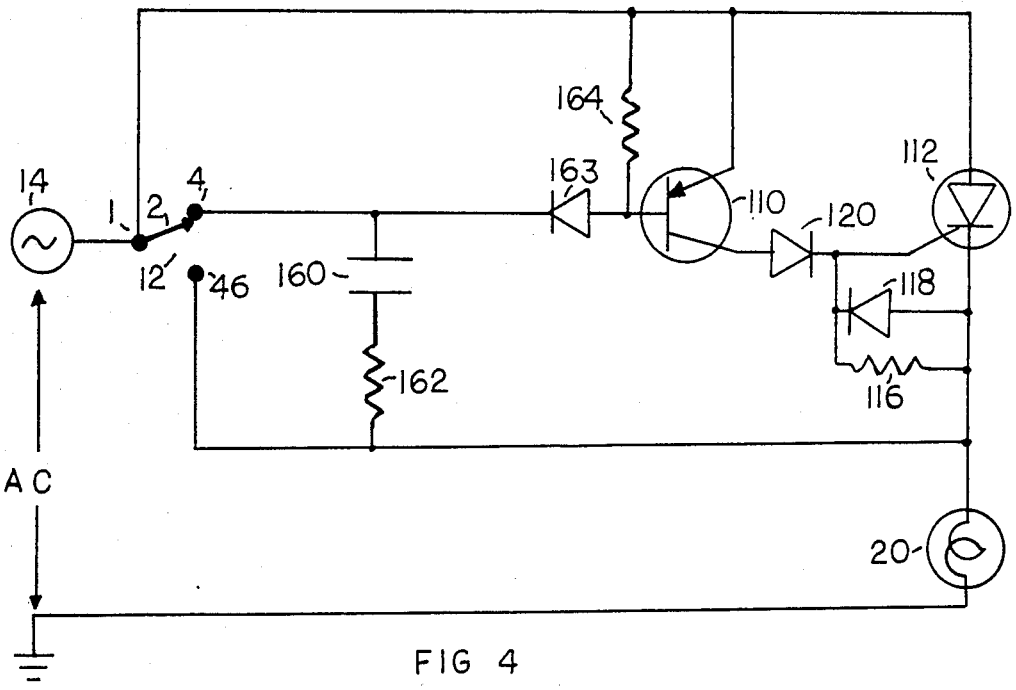

The fourth embodiment is shown in FIG. 4, and its warm-up current delivery means is similar to that of the third embodiment, transistor 110, diodes 120 and 118, SCR 112, and resistors 116,162. The difference in the fourth is the termination circuit which includes capacitor 160, diode 163, and resistor 164; capacitor 160 and resistor 162 are in series. When the switch initially begins its transition and the power supply 14 puts out positive voltage, base current (input current) flows out of pnp transistor 110 and through capacitor 160 and resistor 162. This current also activates transistor 110 and SCR 112 to deliver the warm-up current. When the base current flows, capacitor 160 gradually charges, and as it charges, it raises the threshold for activation of transistor 110 and SCR 112 and so delays delivery of the warm-up current within each positive half cycle of power supply voltage —until the power supply puts out greater voltage than the opposing capacitor voltage. Finally, when the capacitor reaches the peak voltage of the line, transistor 110 can no longer be forward biased by the power supply and SCR 112 can no longer deliver warm-up current.

Diode 163 prevents discharge of capacitor 160 during transition and the negative portion of the power supply voltage, and thus, should allow little reverse current under operating voltage compared to the charging current. Resistor 164 ensures a minimum charging current equal to one p-n voltage drop divided by resistance 164 so that a maximum time for the shut off voltage of capacitor 160 can be calculated regardless of the gain of transistor 110 and SCR 112 and the load; these gains and load influence the base current out of transistor 110 and the charging current to capacitor 160.

The following values for components and diode and SCR specification were utilized in a test to provide a 2 second maximum transition time; resistor 162—470 kilohms, capacitor 160—0.001 microfarads, resistor 164—2 megohms, and diode 163 having a 400 volt breakdown voltage rating and the SCR specified above. Other values can be used without deviating from the spirit of the invention such as a larger value for resistor 162 which decreased the maximum warm-up time, and a larger value for capacitor 160 which increased this time.

Note that the charging current to capacitor 160 only flows for a short duration, beginning when the power supply voltage initially exceeds the capacitor voltage and ending when the SCR 112 has been activated. Once activated, this SCR no longer needed gate current to remain in its conducting mode and so, drove the load to nearly the power supply voltage (approximately 1–2 volts less). This high load voltage "pushed up" the reference voltage of the bottom plate of capacitor 160 so its top plate was above the power supply voltage, diode 163 was reversed biased, and capacitor 162 did not receive any more charging current during the half cycle of power supply voltage. Thus, capacitor 160 charged slowly, and to accurately predict its charging rate and the maximum warm-up time, requires a knowledge of the activation time of SCR 112.

In a variation to the fourth embodiment, one or more transistors are used to deliver the warm-up current instead of SCR 112 as in the first or second embodiments. This configuration requires a larger value for capacitor 160 since, with the transistor output, the input current from transistor 110 must flow whenever the warm-up current flows, so the capacitor receives more charging current. Also, in this design, the output voltage drop always follows the capacitor voltage so significantly more power is dissipated than in the other embodiments.

In another variation to the third or fourth embodiments, an anode gate SCR can substitute for transistor 110 and SCR 112 with the anode gate connecting to the off throw contact 4, the anode connecting to the pole and the power supply, and the cathode connecting to the load and the on throw contact. However, I have not yet tested this design.

I claim:

1. A warm-up and switch circuit comprising:

a double throw switch having an off throw contact and an on throw contact;

means responsive to the position of the switch for delivering a warm-up current from a power source to a load when the switch is in transition, the average power delivered to said load by said warm-up current being substantially less than the average power which could be drawn by said load during the same interval if said load was instead connected by a short circuit directly to said power source;

means for short circuiting said power supply to said load via said on throw contact when the switch is on; and means for terminating said warm-up current after it has significantly warmed-up said load and said switch is still in transition.

2. The circuit of claim 1 wherein the termination means includes a capacitor which charges as the warm-up current flows, and means, responsive to the voltage of the capacitor, for shutting off the warm-up current.

3. The circuit of claim 1 wherein the termination means acts to shut off the warm-up current after ¼ second but before 10 seconds of flow.

4. The circuit of claim 1 wherein said means for delivering a warm-up current includes an amplifier having an activation control port coupled to said off throw contact and said termination means includes:

a capacitor;

means for charging said capacitor while the warm-up current flows;

a transistor having an output coupled to said activation control port of said amplifier; and means for activating said transistor when the capacitor reaches a threshold voltage and thereby shutting off said amplifier.

5. The circuit of claim 4 wherein:

the switch has a pole; and the transistor has its collector and emitter legs connected between the pole of the switch and the actuation control port of the amplifier.

6. The circuit of claim 1 wherein said termination means includes:

a capacitor;

a transistor;

a resistor connected in parallel with the collector and emitter legs of said transistor, and connected in series with said capacitor to pass charging current to the capacitor until said capacitor reaches a threshold voltage;

means for activating said transistor when the capacitor reaches the threshold voltage to bypass said resistor and increase the charging current; and means, responsive to the voltage of said capacitor, for shutting off the warm-up current.

7. The circuit of claim 1 wherein the warm-up current delivery means includes means for half wave rectifying the warm-up current.

8. The circuit of claim 1 wherein:

the switch has a pole; and the warm-up current delivery means includes a silicon controlled rectifier connected between the pole and the load such that said warm-up current passes primarily through the anode and cathode of said silicon controlled rectifier.

9. The circuit of claim 8 wherein the warm-up current delivery means further includes a pnp transistor whose emitter to base junction connects between the pole and the off throw contact of the switch, and the gate of the silicon controlled rectifier is fed by current from the collector of the pnp transistor.

10. The circuit of claim 1 wherein the switch has a pole, and the warm-up current delivery means includes an amplifier comprising a plurality of cascaded transistors and having an input, an output, and a power supply connection, the input coupled to the off throw contact of the switch, the output coupled to the on throw contact and to the load, and the power supply connection coupled to the pole of the switch.

11. The circuit of claim 1 wherein the switch is single pole double throw.

12. The circuit of claim 1 wherein:

the warm-up current delivery means includes a resistor which passes activation current of the warm-up current delivery means; and the termination means includes a capacitor connected in series with said resistor, said capacitor charging from said activation current when the switch is in transition and opposing flow of the activation current setting progressively increasing threshold voltages for activation of the warm-up current delivery means.

13. A warm-up and switch circuit comprising:

a double throw switch having an off throw contact and an on throw contact;

means responsive to the position of the switch for delivering a warm-up current from a power source to a load when the switch is in transition, the average power delivered to said load by said warm-up current being significantly less than the average power wich could be drawn by said load during the same interval if said load was instead connected by a short circuit directly to said power source, said means for delivering a warm-up current including a silicon controlled rectifier, said means for delivering a warm-up current being deactivated when the switch is off; and means for short circuiting said power source to said load via said on throw contact when the switch is on.

14. The circuit of claim 13 wherein the switch is single pole double throw, and the silicon controlled rectifier connects between the pole and the load.

15. A switch circuit comprising:

a double throw switch having an off throw contact, an on throw contact, and a pole, means, coupled to said switch and triggered by movement of said switch from its off position, for delivering a warm-up current from a power source to a load while the switch is between its off and on positions, the average power delivered to said load by said warm-up current being significantly less than the average power which could be drawn by said load during the same interval if said load was instead connected by a short circuit directly to said power source, said means for delivering a warm-up current being substantially turned off when the switch is turned off, and means for short circuiting said power source to said load when the switch is on.

16. A switch circuit as set forth in claim 15 wherein said means for delivering a warm-up current is triggered by a loss of an electrical connection between said pole and said off throw contact when the switch is moved from its off position.

17. A switch circuit as set forth in claim 16 wherein said switch includes a switching mechanism movable between said off throw contact and said on throw contact to make, respectively, an electrical connection associated with an off position of said switch and an electrical connection associated with an on position of said switch, and said warm-up current bypasses said switching mechanism.

18. A switch circuit as set forth in claim 17 wherein said means for delivering a warm-up current comprises an amplifier having an activation control port coupled to said off throw contact, a power input port coupled to the pole and an output port which passes said warm-up current, said amplifier being active while said switch is in transition and being inactive while said switch is in both its off and on positions.

19. A switch circuit as set forth in claim 15 wherein said warm-up current is half-wave rectified.

20. A warm-up and switch circuit for a load, said circuit comprising:

a switch having a pole, an on throw contact, an off throw contact, and a switching mechanism movable between said off throw contact and said on throw contact to make, respectively, an electrical connection associated with an off position of said switch and an electrical connection associated with an on position of said switch, means for turning off the load when the switch is in the off position and for delivering a warm-up current from a power source to the load when the switch is between the off and on positions, the average power delivered to said load by said warm-up current being significantly less than the average power which could be drawn by said load during the same interval if said load was instead connected by a short circuit directly to said power source, said warm-up current bypassing said switching mechanism, and means for delivering full power to the load via said switching mechanism and said on throw contact of the switch when the switch is in the on position.

21. A circuit as set forth in claim 20 wherein said means for delivering full power to the load when the switch is in the on position comprises means for short circuiting said power source to said load via said on throw contact of the switch and said pole of the switch when the switch is on.

22. A circuit as set forth in claim 21 wherein the turning-off and warm-up current delivery means includes rectifying means connected between the pole of the switch and the on throw contact for delivering a half-wave rectified current to said load.

23. A warm-up and switch circuit as set forth in claim 20 wherein the turning off and warm-up current delivery means comprises a first transistor, and means for turning off said first transistor when the switch is in the off position and for turning on said first transistor when the switch is between the off and on positions to cause a current to be delivered to the load.

24. A warm-up and switch circuit as set forth in claim 23 wherein the turning-off and warm-up current delivery means further comprises a silicon controlled rectifier connected between said power source and said load and means for delivering current from said first transistor to a gate of said silicon controlled rectifier to cause said silicon controlled rectifier to deliver warm-up current to said load.

25. A warm-up and switch circuit as set forth in claim 20 further comprising means for terminating said warm-up current during a transition of said switch when said transition lasts a predetermined time, which time is longer than ordinarily required to turn said switch on.

26. A warm-up and switch circuit as set forth in claim 20 wherein the turning off and warm-up current delivery means comprises an amplifier having an activation control port, a power input port, and an output port, and the off throw contact of the switch is coupled to said activation control port of said amplifier, the pole of the switch is coupled to said power supply input port of said amplifier, and the on throw contact of the switch is coupled to said output port of said amplifier to reverse bias and thereby turn off said amplifier when the switch is on, said amplifier also being turned off when the switch is in the off position and being turned on to deliver said warm-up current to the load when the switch is in transition.

27. A warm-up and switch circuit as set forth in claim 26 wherein said amplifier comprises a pnp transitor whose base is coupled to said off throw contact, whose emitter is coupled to said pole of the switch, and whose collector delivers at least some of said warm-up current.

28. A switch circuit comprising:

a single pole double throw mechanical switch having an input for receiving current from a power source and an output for interfacing to a load, warm-up means for delivering a substantially half-wave rectified current from said power source to said load when the switch is in transistion, said power source is connected to said input and said load is connected to said output, said warm-up means having an activation control input port coupled to said off throw contact and a power input port for receiving current from said power source, and means including said off throw contact for unimpededly connecting said activation control input port of said warm-up means to said power input port of said warm-up means when the switch is off to shut off said warm-up means.

29. A switch circuit comprising:

a single pole double throw mechanical switch having an input for receiving current from a power source and an output for interfacing to a load and a switching arm, the pole of the switch short circuited to said input, means for shutting off the load when the switch is off and the load is connected to said output and for delivering a half-wave rectified current to said load when the switch is in transition and said load is connected to said output, said half wave rectified current bypassing said switching arm, and means for shor circuiting said switching arm to said output of said swich when the switch is in the on position.

30. A switch circuit as set for in claim 29 wherein said means for delivering a half-wave rectified current comprises a pnp transistor whose base is coupled to an off throw contact of said switch, whose emitter is coupled to said pole, and whose collector delivers current to said output.

31. A method for warming up a load at a reduced rate and then turning said load on fully, said method comprising the steps of:

applying voltage from a power source directly to an input of a double throw switch, connecting a load directing to an output of the double throw switch, moving a switching mechanism of the double throw switch from its off position to its on position, delivering a reduced warm-up current from the power source through the input of the switch and to the load while the switch is in transition to warm-up said load more gradually than if said load was connected by a short circuit directly to said power source, said reduced warm-up current by passing said switching mechanism, and delivering full power to the load via said input and said output of said switch while the switch is on.

32. A method as set forth in claim 31 wherein the step of delivering a reduced warm-up current is performed by delivering a half-wave rectified current to the load when the switch is in transition.

33. A method as set forth in claim 32 wherein the step of delivering full power to the load when the switch is on comprises the step of short circuiting said power supply to an output of said switch.

* * * * *